United States Patent [19]

Straub et al.

[11] Patent Number: 5,029,360

[45] Date of Patent: Jul. 9, 1991

[54] CLEANING APPARATUS FOR MACHINES

[75] Inventors: Johann-Baptist Straub, Wangen-Primisweiler; Peter Hutter, Wangen, both of Fed. Rep. of Germany

[73] Assignee: Sohler Airtex GmbH, Wangen, Fed. Rep. of Germany

[21] Appl. No.: 496,424

[22] Filed: Mar. 20, 1990

[30] Foreign Application Priority Data

Mar. 20, 1989 [DE] Fed. Rep. of Germany ... 8903472[U]

[51] Int. Cl.[5] ..... A47L 5/38

[52] U.S. Cl. ..... 15/312.1; 15/312.2; 15/316.1

[58] Field of Search ..... 15/312.2, 316.1, 312.1

[56] References Cited

U.S. PATENT DOCUMENTS

| | | | |
|---|---|---|---|
| 4,121,318 | 10/1978 | Jacobi | 15/312.2 |
| 4,473,409 | 9/1984 | Greeley | 15/312.1 |
| 4,559,721 | 12/1985 | Hanna | 15/316.1 |
| 4,563,788 | 1/1986 | Kobayashi | 15/316.1 |
| 4,655,258 | 4/1987 | Breyer et al. | 15/312.2 |
| 4,688,292 | 8/1987 | Schmiegel | 15/315 |
| 4,864,679 | 9/1989 | Briner | 15/312.2 |
| 4,934,018 | 6/1990 | Fortier et al. | 15/312.1 |

*Primary Examiner*—Jimmy G. Foster
*Assistant Examiner*—M. D. Patterson
*Attorney, Agent, or Firm*—Robert W. Becker & Associates

[57] ABSTRACT

A cleaning apparatus for textile machines or the like is provided. A track is disposed above different types of machines. Extending to the side of the machines are suction and/or blowing hoses that are movable transverse to the direction of movement of the cleaning apparatus. This movement is controlled by a parallelogram guide means, which is mounted in such a way via a control mechanism that the parallelogram guide means is laterally displaceable into at least two positions.

10 Claims, 3 Drawing Sheets

CLEANING APPARATUS FOR MACHINES

BACKGROUND OF THE INVENTION

The present invention relates to a cleaning apparatus for textile machines or the like, and includes track means disposed above and alongside a row of different types of textile machines, with the cleaning apparatus running on the track means and including suction and/or blowing hoses that extend to the side of the textile machines, whereby when passing from one type of machine to another, a lower hose portion is movable relative to an upper hose portion in a direction transverse to the direction of movement of the cleaning apparatus.

Such cleaning apparatus are conventionally mounted on track means above the textile machines and are movable along a row of such machines, with the cleaning apparatus serving to keep the textile machines clean via appropriate blowing and suction hoses. In conformity with the rail means that are provided, a number of textile machines can be passed "in a single operation", which offers an economical possibility for cleaning the textile machines.

For the purpose of providing an integrated manufacture, more and more frequently different types of textile machines are disposed in a single room, possibly closely adjacent one another. Accordingly, for example, ring spinning frames and winding frames are then disposed next to one another and should be cleaned with the same cleaning apparatus. For this purpose, a number of approaches have been proposed in order to achieve an adaptation of the position of the blowing and suction hoses to the different cleaning requirements of the different textile machines, in each case as a function of the textile machine that the cleaning apparatus will pass.

For example, it is known to roll up or raise a blowing hose when an obstacle is encountered, although in such a case the cleaning effect of the blowing and suction hoses are then essentially discontinued.

Pursuant to a further proposal, the hoses are mounted about a swivel joint that has a vertical axis of rotation, via which a pivoting is to be produced that at the same time allows an adaptation of width.

However, this approach has various drawbacks: For one thing the jet is always pivoted along during the pivoting movement, so that it is no longer possible to ensure an alignment relative to the textile machine. On the other hand, it has been shown that the movable hoses are especially inclined during a rotational movement toward centrifugal and swinging movements due to the centrifugal force; these movements can even be dangerous for the environment of the blowing hose, and in every case reduces the service life of the blowing hose.

Stronger material was therefore used for the hoses in order to keep the extent of damage as low as possible.

However, when stronger and hence heavier hoses are used, the centrifugal forces become greater, so that the bearings in the pivot joints must be correspondingly strengthened in order to absorb both the axial as well as the radial stresses.

It is furthermore known with these pivot joint hoses to ensure the position of the jets or suction nozzles of the hoses that face the textile machines by having special devices to compensate for the rotation of the hose and thereby hopefully keep the jets in position.

However, this approach is, on the one hand, expensive. In addition, this approach is very susceptible to problems since it is precisely in the region of the suction nozzles that dust can settle very easily in the pivot bearing gap for the respective suction nozzle, so that the turning device for the suction nozzle becomes stuck.

It is therefore an object of the present invention to provide a cleaning apparatus of the aforementioned general type for textile machines or like that permits an adaptation to different types of machines that must be travelled past one after the other, but which operates in a more reliable manner can be adapted in a more flexible manner, and yet requires very little structural expense.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

Figure 1:
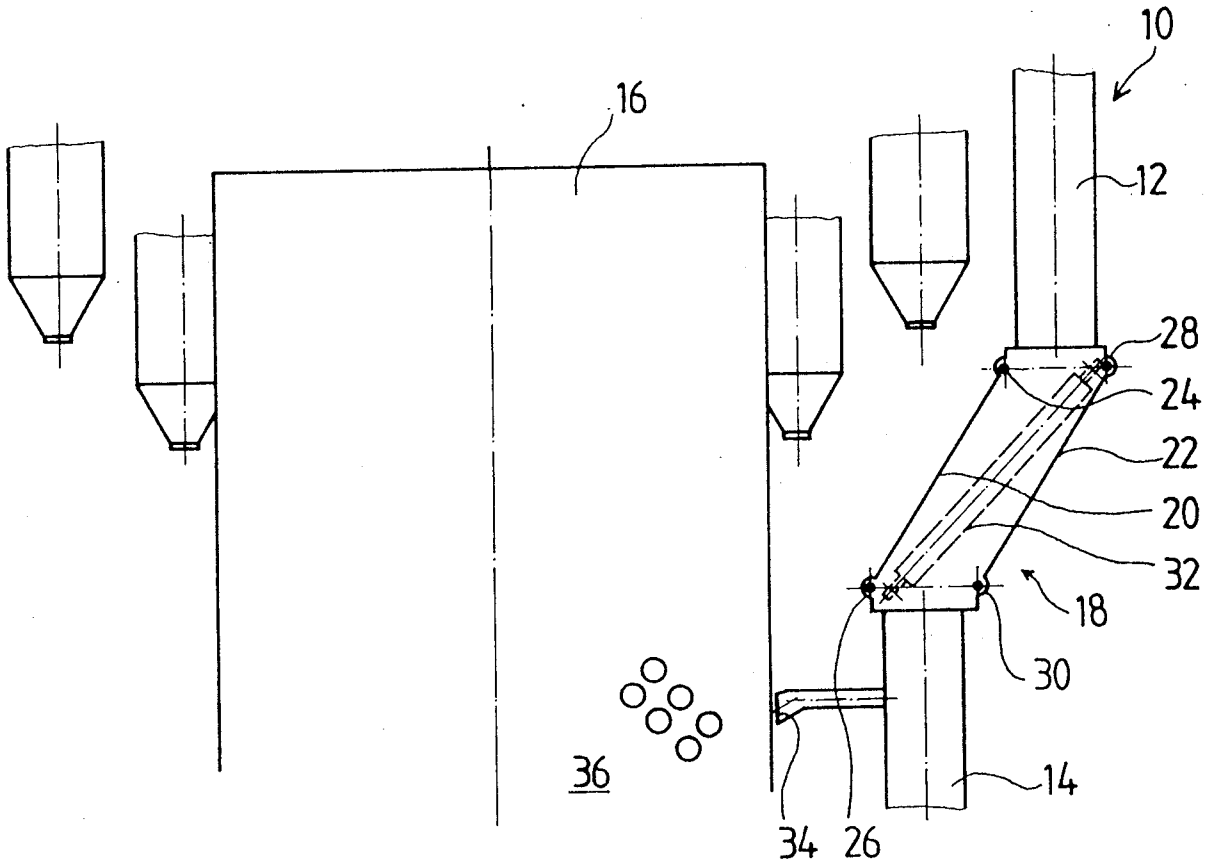
FIG. 1 shows the lower part of one exemplary embodiment of the inventive cleaning apparatus as it passes a ring spinning frame.

The cleaning apparatus of the present invention is characterized by: a parallelogram guide means for controlling the transverse movement of the lower hose portion relative to the upper hose portion; and a control mechanism for mounting the parallelogram guide means in such a way that the guide means is laterally displaceable into at least two positions.

With the inventive translatory movement of the lower hose portion, the necessary adjustment in width can be accomplished with the least possible amount of movement. It is particularly advantageous that selectively the jets remain at the same level in both end positions due to the parallelogram guide means, or an adaptation of height to the desired extent can be undertaken. For this purpose, it is merely necessary to appropriately select the adjustment range of the parallelogram. An adjustment inwardly out of the vertical position results in an initially practically negligible but then increasing raising of the jets on the lower hose portion, which with a symmetrical parallelogram guide means corresponds to the same raising when the parallelogram is guided toward the outside.

The extent to which the jets on the lower hose portion move can be adapted to the requirements over a wide range by the geometry of the parallelogram guide means.

It is also particularly advantageous that the parallelogram guide means can be used in common for a plurality of hoses that are generally guided parallel to one another; in contrast to the known rotatability or pivotability about the vertical axis, this offers a considerable advantage with regard to structural expense. It should be noted that cleaning apparatus generally have a number of blowing and suction hoses.

The control mechanism for the parallelogram guide means, via which the adjustment into at least two positions is effected, can advantageously be embodied as a pressure cylinder, for example a hydraulic cylinder, that is mounted between two diagonally opposite securement points on the upper and lower hose portions. This enables a particularly easy adjustment of the parallelogram.

The inventive cleaning apparatus can be provided with an automatic adjustment of the cleaning width via straightforward means, for example by providing at the boundary between a row of ring spinning frames and a row of winding frames an actuation element that acts upon a corresponding sensor mounted on the cleaning apparatus. As soon as the sensor of the cleaning apparatus passes into the region of the actuation element, the control mechanism for the parallelogram guide means is activated, so that the suction and/or blowing hoses are brought into the desired position.

Pursuant to a specific embodiment of the present invention, the control mechanism can adjust the parallelogram guide means in a locking manner. Alternatively, the control mechanism can effect an infinite adjustment of the parallelogram guide means.

Further specific features of the present invention will be described in detail subsequently.

DESCRIPTION OF PREFERRED EMBODIMENTS

Referring now to the drawings in detail, FIG. 1 shows one exemplary embodiment of the inventive cleaning apparatus, and in particular illustrates a hose 10 that has two parts, namely an upper hose portion 12 and a lower hose portion 14. The upper hose portion 12 is connected with the fan of the cleaning apparatus, which is not shown in greater detail and which is supported above a ring spinning frame 16 via a rail means.

Provided between the upper hose portion 12 and the lower hose portion 14 is a parallelogram guide means 18 that permits a pivoting of the lower hose portion 14 to one side relative to the upper hose portion 12, and hence at the same time relative to the ring spinning frame 16. The parallelogram guide means 18 is provided with two guide rods 20 and 22, each of which extends from the upper hose portion 12 to the lower hose portion 14, and is movably mounted on each via bearing means 24, 26, 28, and 30. In the illustrated embodiment, the two guide rods 20 and 22 each have the same length, thereby ensuring an exact parallel guidance.

Extending between the two bearing means 26 and 28 that are disposed diagonally across from one another is a pressure cylinder 32, for example a hydraulic cylinder, that is operable with a pressure medium in a known manner, so that by changing the length of the pressure cylinder 32 at the same time an adjustment of the parallelogram guide means 18 is effected. When the pressure cylinder 32 is extended, the lower hose portion 14 is moved closer to the ring spinning frame 16, and when the pressure cylinder 32 is retracted, the lower hose portion 14 is moved away from the ring spinning frame 16.

Cleaning of the ring spinning frame 16 is effected via a plurality of jets and suction nozzles, with one jet 34 being illustrated in FIG. 1 and being mounted on the lower hose portion 14 for blowing against a region 36 of the ring spinning frame 16 that is to be cleaned.

For an airtight connection of the lower hose portion 14 to the upper hose portion 12, a sleeve or a very flexible hose (not illustrated in FIG. 1) is provided that permits not only a lateral movement but also a certain change in length, and that can, for example, be embodied as a bellows.

Figure 2:
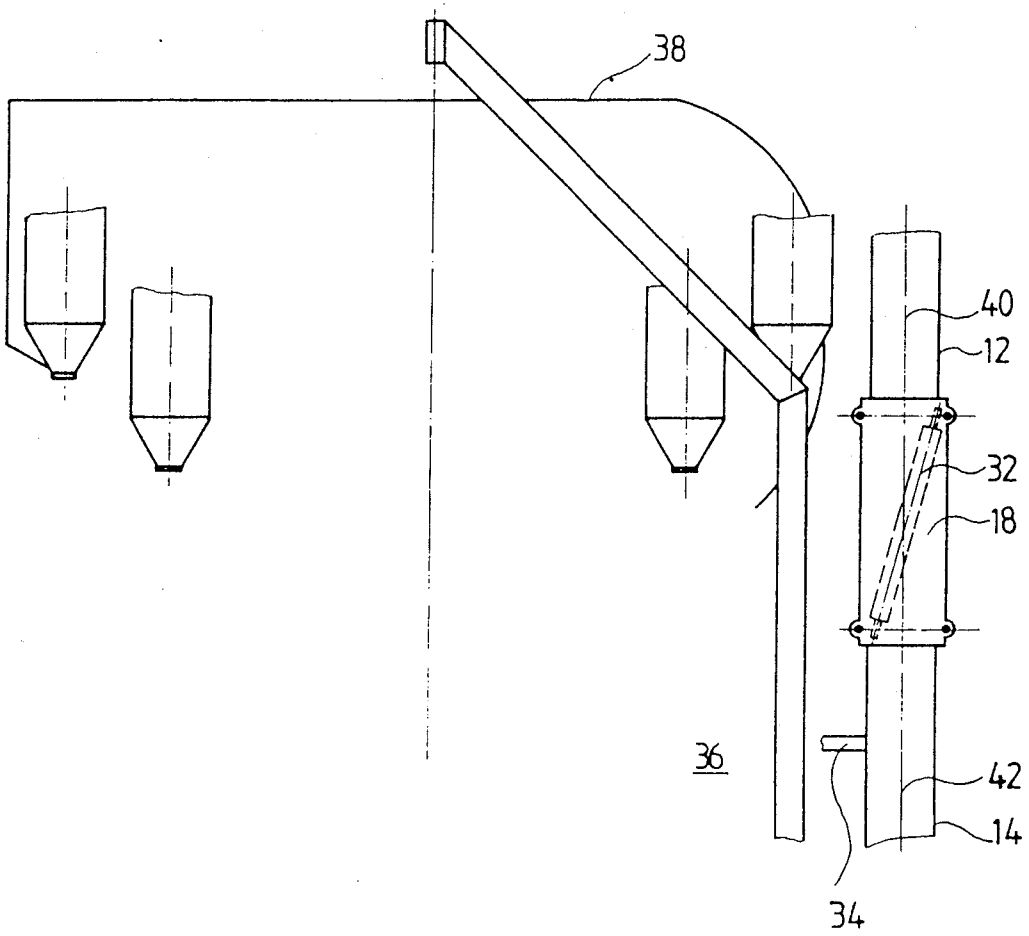
FIG. 2 shows the cleaning apparatus of FIG. 1 as it passes a winding frame.

In the illustration of FIG. 2, parts that correspond to FIG. 1 have the same reference numeral and require no further explanation.

In the state illustrated in FIG. 2, the inventive cleaning apparatus is passing a winding frame 38 that has a greater overall width than does the ring frame 16 of FIG. 1. As a result, the parallelogram guide means 18 is in a different position, and the pressure cylinder 32 is not as long. In the state illustrated in FIG. 2, the axes 40 and 42 of the hose portions 12 and 14 are coaxial to one another. Accordingly, the bearing means 26 and 24 on the one hand and 30 and 28 on the other hand are disposed exactly over one another, and the parallelogram guide means 18 defines a rectangle, whereas in the position illustrated in FIG. 1, the parallelogram guide means 18 forms a trapezoid. In the coaxial position of the axes 40 and 42, the resistance of the hose 10 to flow is at its least, so that this position should be used for the greatest desired suction or blowing capacity.

Pursuant to the present invention, the same jet 34 is used to act upon and hence clean a corresponding region 36 of the winding frame 38.

In a modification of the illustrated embodiment, it is proposed to couple an adjustment of the jet 34 with an adjustment of the lower hose portion 14 via the parallelogram guide means 18 in order to achieve an even better adaptation to the desired cleaning effect of the winding frame 38.

Under very specific circumstances it can be expedient to replace the parallelogram guidance by a translatory guidance of the lower hose portion 14 relative to the upper hose portion 12, whereby a change in height of the jet 34, relative to the upper hose portion 12, is not effected.

Figure 3:
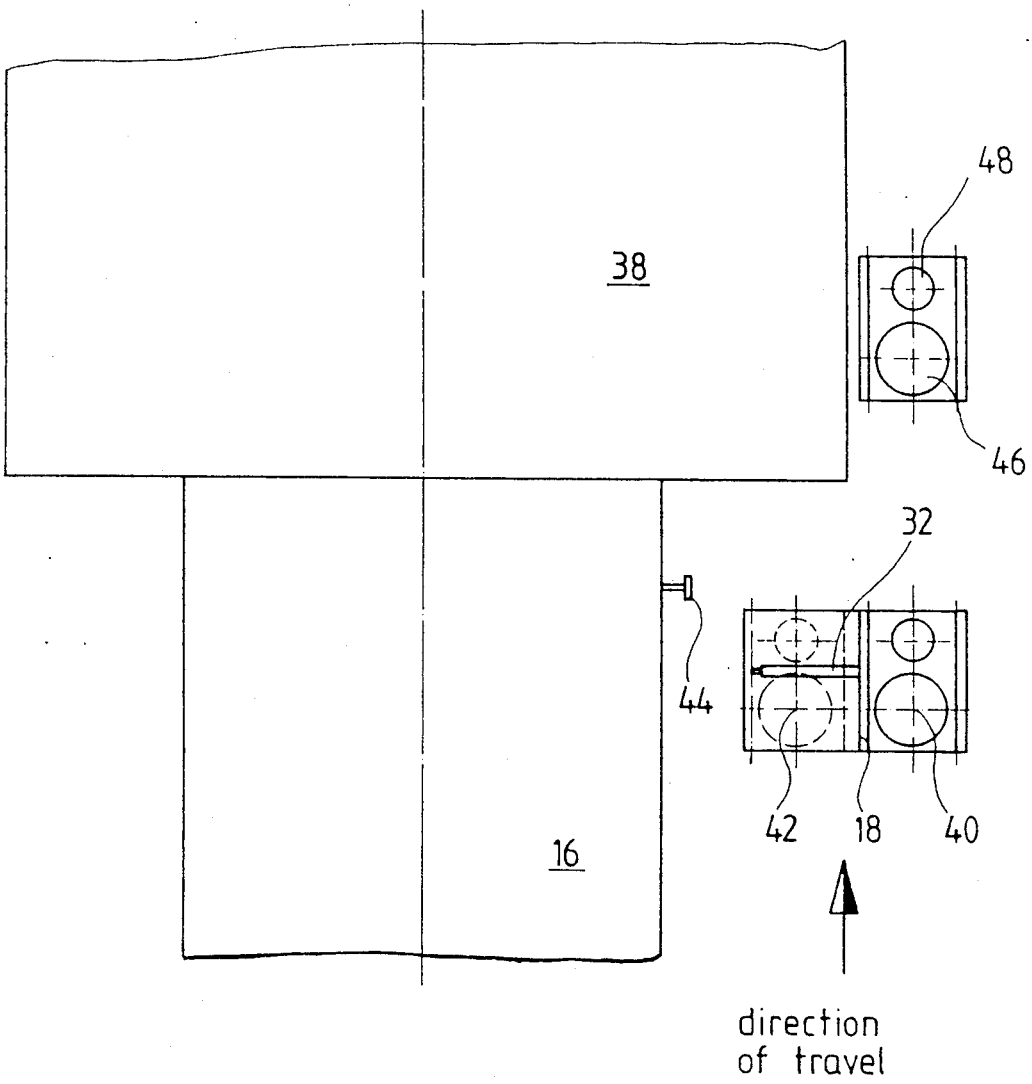
FIG. 3 is a partial view from above of part of the inventive cleaning apparatus of FIG. 1 showing two states of the cleaning apparatus as it cleans the ring spinning frame and as it cleans the winding frame.

In the illustration of FIG. 3, the inventive cleaning apparatus is shown in two states, namely in the cleaning position for the winding frame 38 as well as in the cleaning position for the ring spinning frame 16. A switching-over from the narrower cleaning position for the ring spinning frame 16 to the wider cleaning position for the winding frame 38 is effected via an actuation element 44 to which a correspondingly embodied sensor on the cleaning apparatus responds. As can be seen from FIG. 3, the parallelogram guide means 18 effects an adjustment of a number of hoses in a single operation, whereby a suction hose 46 and a blowing hose 48 that are mechanically interconnected in FIG. 3 are moved together via the parallelogram guide means 18.

It is, of course, also possible to pivot the inventive cleaning apparatus into more than two positions, and in particular into a position in which the axis 42 of the lower hose portion 14 comes to rest outwardly beyond the axis 40 of the upper hose portion 12. If desired, the coaxial position of the axes 40 and 42 can also be provided in a transition region between the two end positions in which the cleaning of different textile machines is effected.

The present invention is, of course, in no way restricted to the specific disclosure of the specification and drawings, but also encompasses any modifications within the scope of the appended claims.

What we claim is:

1. In a cleaning apparatus for machines, and including track means disposed above and alongside a row of different types of machines, with said cleaning apparatus running on said track means and including suction and/or blowing hoses that extend to the side of said machines, whereby when passing from one type of machine to another, a lower hose portion is movable relative to an upper hose portion in a direction transverse to the direction of movement of said cleaning apparatus, with means being provided for establishing a suction or blowing connection between said upper and said lower hose portion, the improvement comprising:

a parallelogram guide means for controlling said transverse movement of said lower hose portion relative to said upper hose portion; and a control mechanism for mounting said parallelogram guide means in such a way that said guide means is laterally displaceable into at least two positions, with said control mechanism being in the form of a pressure cylinder that engages said parallelogram guide means in a diagonal direction thereof.

2. A cleaning apparatus according to claim 1, in which said parallelogram guide means has an outer position for moving past wider machines, in which position said upper and lower hose portions extend essentially coaxially to one another.

3. A cleaning apparatus according to claim 1, in which said parallelogram guide means has an outer position for moving past auxiliary devices such as flyer bobbin changers or thread knotters that are movable parallel to said machines, in which position said lower hose portion is disposed outwardly of said upper hose portion.

4. A cleaning apparatus according to claim 1, in which said control mechanism for said parallelogram guide means is adapted to move said lower hose portion into an arbitrarily selectable position relative to said upper hose portion.

5. A cleaning apparatus according to claim 1, in which said control mechanism is adapted to move said lower hose portion into a plurality of arbitrarily selectable positions.

6. A cleaning apparatus according to claim 1, in which said control mechanism is adapted to adjust said parallelogram guide means in a locking manner.

7. A cleaning apparatus according to claim 1, in which said control mechanism is adapted to adjust said parallelogram guide means in an infinitely variable manner.

8. A cleaning apparatus according to claim 1, in which, said means for establishing a suction or blowing connection between said upper and lower hose portions includes a sleeve that extends between said hose portions and overlaps the region of said parallelogram guide means.

9. A cleaning apparatus according to claim 1, which, for establishing a suction or blowing connection between said upper and lower hose portions, includes a flexible hose that extends between said hose portions and overlaps the region of said parallelogram guide means.

10. A cleaning apparatus according to claim 1, which includes a plurality of hoses combined into a hose unit that is laterally displaceable via a common parallelogram guide means by said control mechanism.

* * * * *